US006290643B1

(12) United States Patent
Falk et al.

(10) Patent No.: US 6,290,643 B1
(45) Date of Patent: Sep. 18, 2001

(54) INITIAL HEATER CONTROL FOR RADIANT INFANT WARMER

(75) Inventors: Steven M. Falk, Baltimore; Michael H. Mackin, Ellicott City, both of MD (US)

(73) Assignee: Datex-Ohmeda, Inc., Tewksbury, MA (US)

( * ) Notice: Subject to any disclaimer, the term of this patent is extended or adjusted under 35 U.S.C. 154(b) by 0 days.

(21) Appl. No.: 09/503,069

(22) Filed: Feb. 12, 2000

(51) Int. Cl.[7] ..... A61G 11/00
(52) U.S. Cl. ..... 600/22
(58) Field of Search ..... 600/21–22

(56) References Cited

U.S. PATENT DOCUMENTS 5,474,517 * 12/1995 Falk et al. ..... 600/22

* cited by examiner

*Primary Examiner*—John P. Lacyk
(74) *Attorney, Agent, or Firm*—Roger M. Rathbun

(57) ABSTRACT

A system and method for controlling the initial start up of a radiant heater used in an infant care apparatus. The system and method provides power to the radiant heater in excess of the 100% rated power of the heater for an initial period of time to cause a more rapid heating of the heater. The system utilizes an initial set power for the heater to determine the period of time that the heater is provided the excess power and discontinues that excess power after the determined period of time so tha the control of the heater is returned to a normal heating algorithm to thereafter provide the control of power to the heater. By use of the excess power upon initial start-up of the radiant heater, the heater more rapidly provides heat to an infant being cared for in the infant care apparatus. In the preferred embodiment, the system and method is used with an infant care apparatus that can be converted from an incubator function to a infant warmer by moving a radiant heater from a lower position where it is not activated to an upper position where the radiant heater is activated.

12 Claims, 4 Drawing Sheets

INITIAL HEATER CONTROL FOR RADIANT INFANT WARMER

BACKGROUND

The present invention relates to an infant care warmer adapted to provide heat for the warming of an infant and, more particularly, to a method of controlling the initial intensity of a heater used in an infant warmer.

In the treatment of infants, and particularly those born prematurely, it is necessary to provide heat to the infant during the treatment of such infants and to minimize the heat loss of the infant. Accordingly, a common apparatus for providing such heat is an infant warmer. In general, the infant warmer comprises a flat, planar surface on which the infant rests while some procedure is being carried out on the infant. There are normally protective guards that surround the infant to keep the infant contained within the apparatus and there is an overhead heater that directs radiant energy in the infrared spectrum toward the infant to impinge upon that infant to provide warmth.

An infant warmer is shown and described in U.S. Pat. No. 5,474,517 of Falk and is an example of the type of infant care apparatus that is used to provide warmth to an infant while carrying our some procedure on that infant There is a difficulty on start up of such radiant heaters in that in many instances, the infant is experiencing a loss of heat and it is therefor prudent to supply the heat to the infant rapidly to reach the desired temperature of the infant. In particular, radiant heaters warm up at a relatively slow process and thus there is a time period that the infant is in need of heat and it would be advantageous to reduce the time period to a minimum.

SUMMARY OF THE INVENTION

Accordingly, the present invention relates to a method and system for controlling the radiant heater used in connection with an infant warmer. The present heater control system is carried out principally in software and provides a control of the radiant heater that increases the start up power to the heater to bring the heater up to the desired heat at a faster rate.

In particular, the present system is especially applicable, but not limited thereto, to the control of the initial start-up of a radiant heater used with an infant care apparatus that combines the functions of an incubator and an infant warmer. With such apparatus, there is a canopy having a radiant heater and the canopy can move between a lower position where it covers vertical sides and a base to enclose therein an infant compartment to create an infant incubator and an upper position where the apparatus functions as a radiant warmer. When the canopy is in the lower position, the radiant heater is disabled and the infant incubator is heated by a convective heating system. When the canopy is raised to the upper position, the convective heating system is disabled and the radiant heater is energized.

Thus, in the operation of the infant apparatus, there a period of time when the canopy is moving from its lower position where the infant is maintained within the very protective, controlled environment of an incubator to the upper position where the infant is basically in a open environment with the radiant heater in position and energized. Thus, during that period of time, the convective system has been de-energized but the radiant heater has not yet been enabled and it is possible for the infant to be cooled. It would therefore be advisable, with the use of the present method, to enable the radiant heater to more rapidly heat up so as to provide the heat to the infant faster than with conventional systems.

In present method and system, the radiant heater is generally rated at a normal power rating for 100% power. Upon start up, however, the present system powers the heater at an increased power for a period of time and then reduces that power at the end of that time period to the normal heater control. In such heaters, there is generally an initial setting, in percentage of power. Upon start up, the system of the present invention sets the radiant heater to the increased power setting for a period of time based upon the initial setting, that is, if the initial start up power is 100% power to the heater, the power to the heater at start up is at an excess of 100% for a period of time, for example 100 seconds. If, on the other hand, the initial set start up power is 50 percent power, upon start up, the power to the heater will be for the same percentage in excess of the 100% rated power but the time period will be a shorter interval, from example, the increased power may be for only 50 seconds.

With the present invention, therefore, there is an initial additional power to the radiant heater to bring the heater up to the desired heat level more rapidly and to provide more rapid needed heat to the infant. Although the present invention will be described with respect to the aforedescribed infant apparatus, it will become clear that the inventive system can be used with any radiant heater to provide a more rapid start of that heater.

These and other features and advantages of the present invention will become more readily apparent during the following detailed description taken in conjunction with the drawings herein.

DETAILED DESCRIPTION OF THE INVENTION

Figure 1:
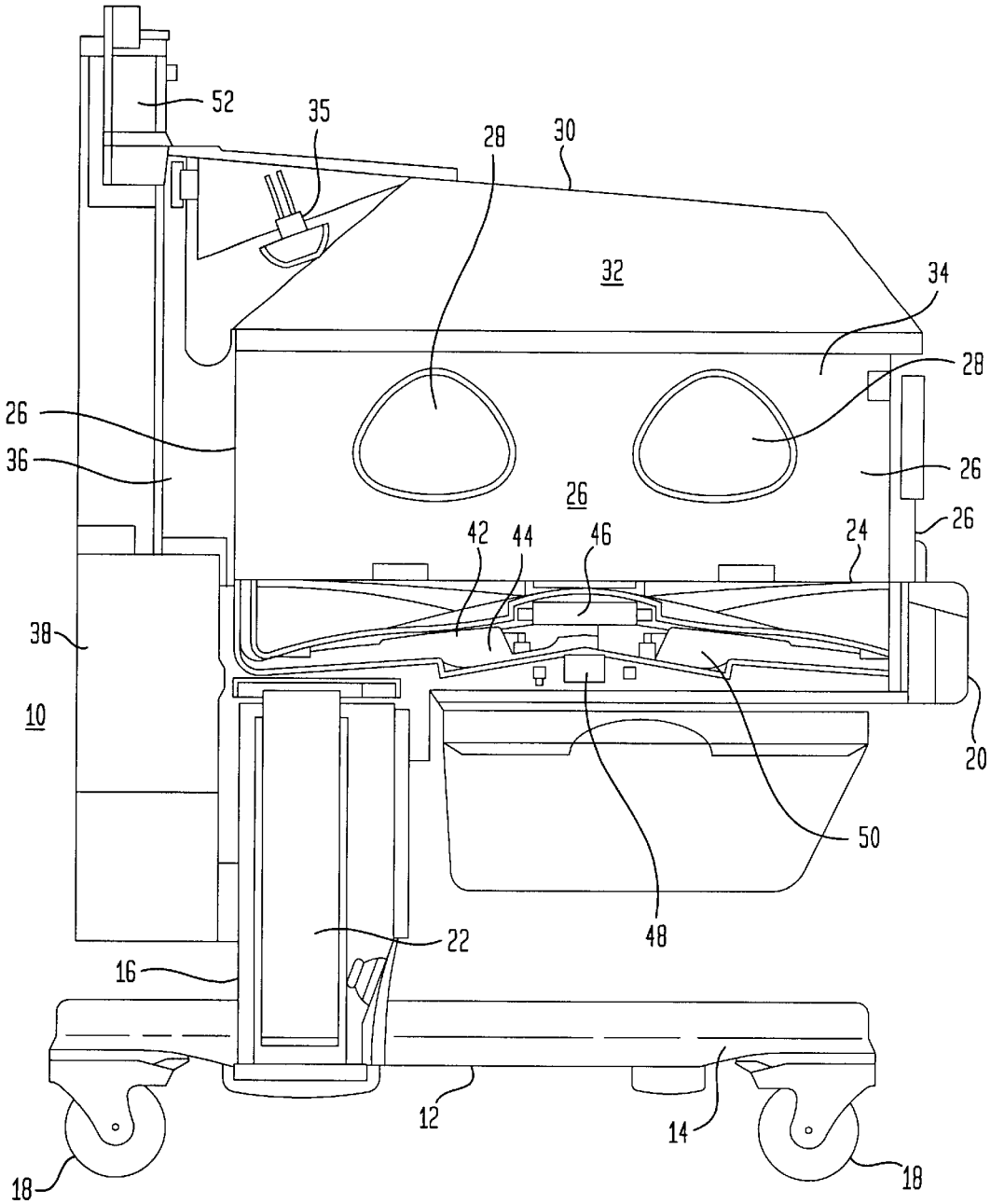
FIG. 1 is a side view of an infant care apparatus used to carry out the present invention with its canopy in the lower position.
Figure 2:
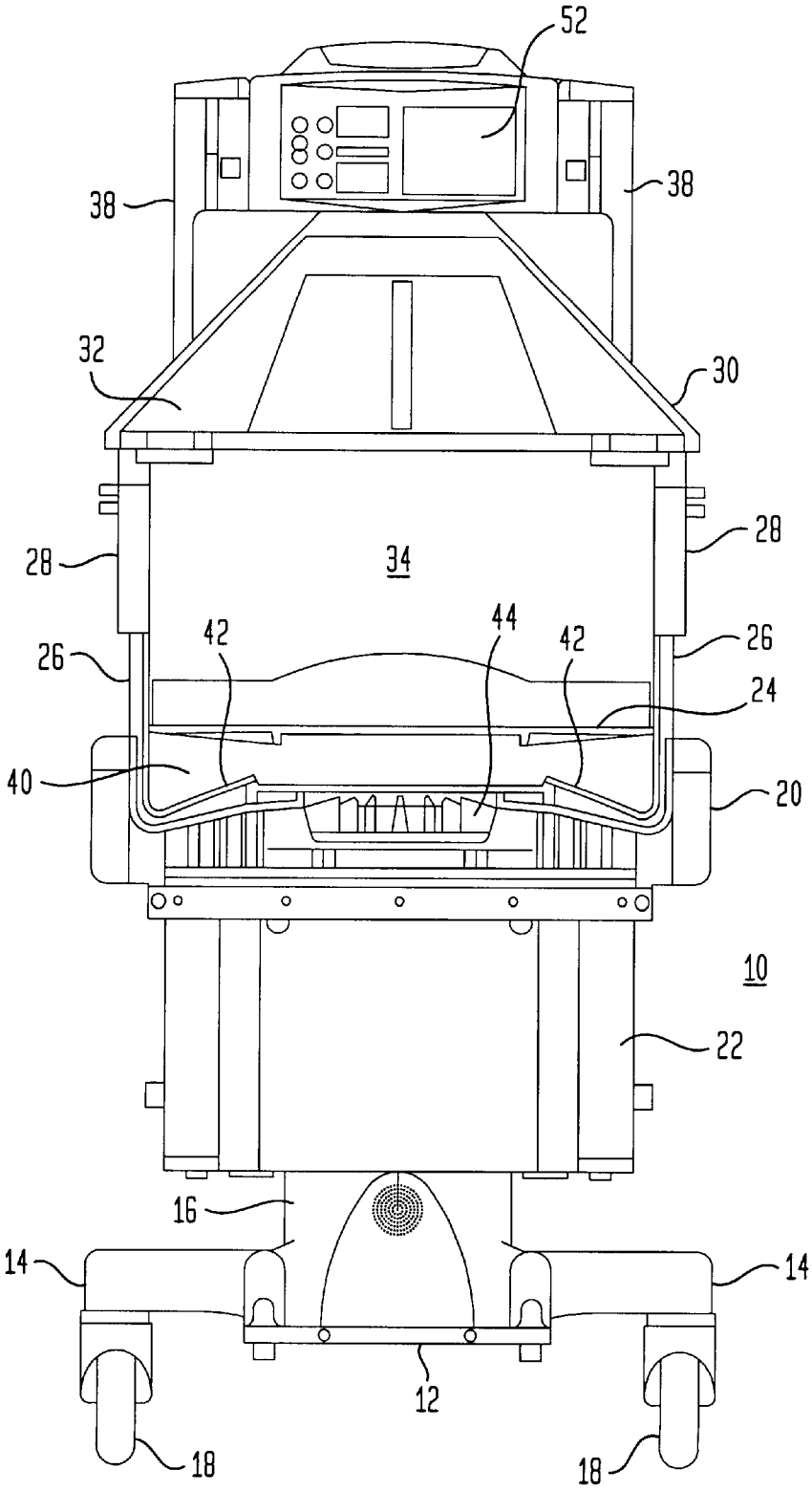
FIG. 2 is an end view of the infant care apparatus of FIG. 1.

Referring now to FIGS. 1 and 2, there are shown, a side view and an end view of an infant warming apparatus 10 constructed in accordance with the present invention in its mode of operation as an infant incubator.

Thus, in the Figs., the infant warming apparatus 10 includes a base 12 comprising a pair of U-shaped members 14 that are joined together and which provide support for a stationary vertical base member 16. Wheels 18 may also be provide for ready movement of the infant care apparatus 10.

An infant platform 20 is provided and which supports an infant in the infant care apparatus 10 and the infant platform 20 may be mounted in cantilever manner to a movable vertical member 22 in a manner such that the user can adjust the height of the infant platform 20 by raising and lowering the movable vertical base member 22 with respect to the stationary vertical base member 16 to the preferred height by the user.

The infant platform 20 includes a flat, planar surface 24 that actually underlies the infant when positioned with the infant care apparatus 10. Extending upwardly around the periphery of the infant platform 20 are a plurality of walls 26, normally of a transparent plastic material and which surround the flat planar surface 24 to enclose the infant on the surface 24. As can be seen, the walls 26 can have handholes 28 to enable the caregiver to reach the infant, however, if even more access is required to the infant, at least the side walls 26 can be dropped downwardly to open fully for complete access to the infant to carry out procedures on the infant or for introducing and removing the infant from the infant care apparatus 10.

A canopy 30 overlies the infant platform 20 and includes a transparent hood 32 that, when in the position as shown in the FIGS. 1 and 2, covers the upper peripheral edges of the walls 26 to enclose therein an infant compartment 34 that provides a controlled environment where heat and humidity can be provided and controlled to aid in the development and well being of the infant. The canopy 30 also includes a radiant heater 35 that, as will be explained, can be employed to direct radiant energy in the infrared range toward an infant resting on the flat planar surface 24 of the infant platform 20, however, that radiant heater 35 is not operational with the canopy 30 positioned as shown in FIGS. 1 and 2.

The canopy 30 can be raised and lowered vertically to cover and uncover the infant compartment 34. The raising and lowering mechanism is not part of the present invention, however a mechanism is described in detail in copending patent application Ser. No. 09/316,506 filed May 21, 1999 entitled Lift Mechanism For Infant Care Apparatus, the disclosure of which is incorporated herein by reference, or may be a lift system as described in the aforementioned Donnelley et al, U.S. Pat. No. 5,453,077. For purposes of the present invention, however, it is sufficient to note that the canopy 30 is affixed to a movable vertical frame member 36 that moves with respect to, and interfits with stationary vertical frame members 38 and a lifting mechanism is used to move the movable vertical frame members 34 and the canopy 30 upwardly and downwardly with respect to the stationary vertical frame members 36.

A heating and air moving compartment 40 is located within the infant platform 20 beneath the flat, planar surface 24 on which the infant is positioned and within the heating and air moving compartment 40 there is located the various ducting 42 and passageways that direct the air up to within the infant compartment 34 and to receive the air from the infant compartment 30 for re-circulation. Those ducting 42 and passageways channel the air that is used to heat the infant compartment 34 and to receive the re-circulated air from the infant compartment 34. Within the heating and air moving compartment, there is a heater 44 and a fan 46 operable by a motor 48 and which heats the air to be introduced into the infant compartment 34 to provide the warmth to the infant. As can be seen, therefore, the heater 44 is located basically in the ducting 42 and the passageways that move the air through the system and thus, as the heater heats the air by a series of fins 50, the heater also heats the ducting 40 by conduction and convection. One of such passageways is an air inlet to the infant compartment 30 shown at 43. Accordingly, as the air is heated prior to introduction into the infant compartment 34, the various ducting and passageways for that air are also being heated by the heater 44.

As other features of the infant warming apparatus 10, a control module 52 is conveniently positioned intermediate the stationary vertical frame members 38 and may include displays of various monitored parameters as well as include the various controls for operation of the functions of the infant care apparatus 10. The control module 52 may also contain the alarm functions that may be set by the user or may be established and preset by the manufacturer.

Figure 3:
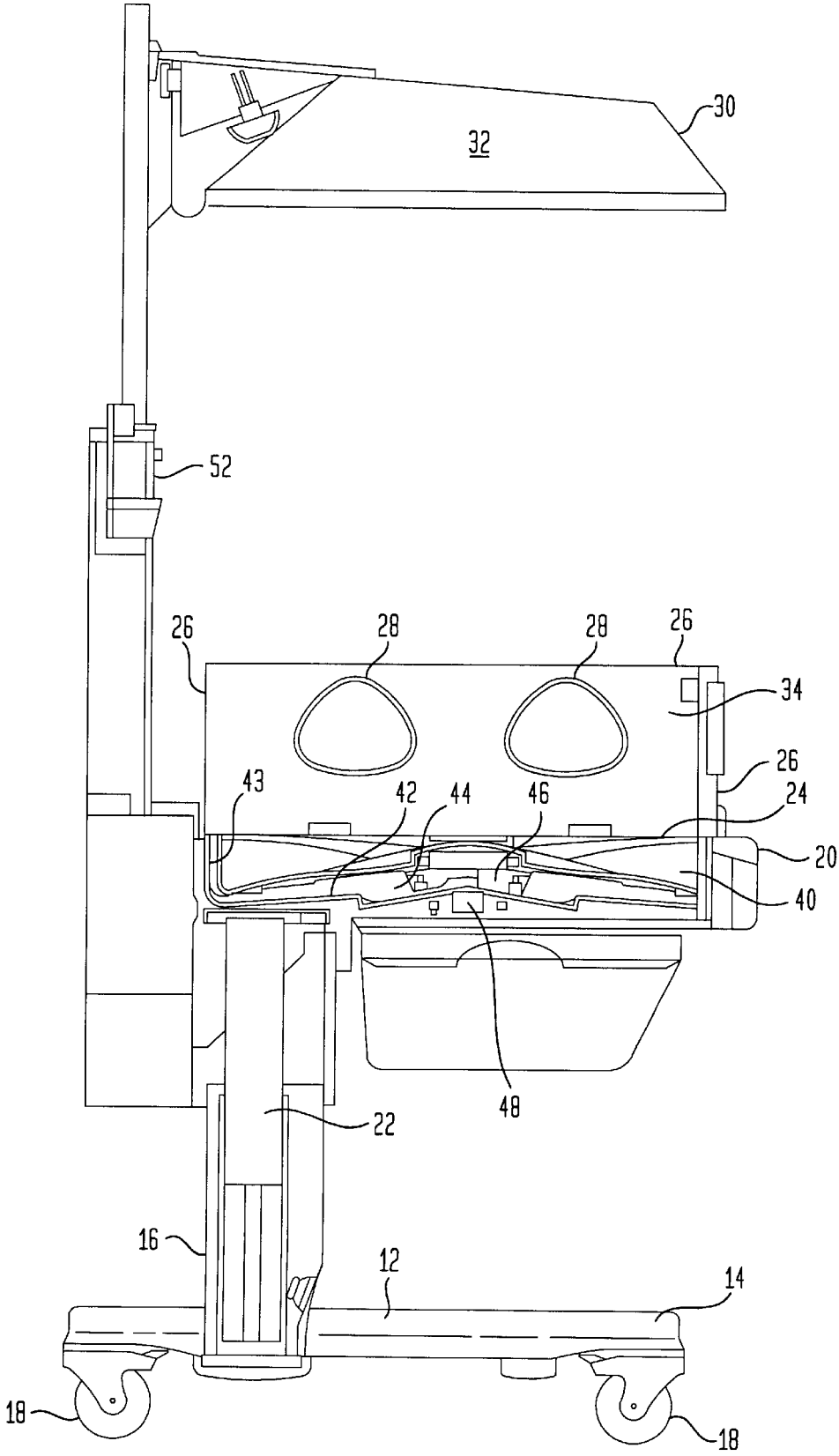
FIG. 3 is side view of the infant apparatus of FIGS. 1 and 2 with its canopy in the upper position.

Turning now to FIG. 3, there is shown a side view of the infant care apparatus constructed in accordance with the present invention and with the canopy 30 in its upper position. In this position, the apparatus acts as an infant warmer as the radiant heater 25 is energized to direct radiant energy in the infrared spectra toward an infant positioned on the flat planar surface 24 of the infant platform 20. In accordance with the control system of the present invention, when the canopy 30 is in the position shown in FIG. 3, the radiant heater 35 is activated and the convective heating system is disabled and is inoperative. Conversely, when the canopy 30 is in its lower position of FIGS. 1 and 2, the convective heating system is operative and the radiant heater 35 is disabled and thus inoperative. Accordingly, unlike the Donnelley patent, previously mentioned, in the present infant care apparatus, only one heating system is operative at any time and at no time can both systems being used to provide heat to the infant.

Thus, as can be seen, the is a period of time when the radiant heater 35 is moving from its lower position as shown in FIGS. 1 and 2, to the upper position of FIG. 3, the infant contained the apparatus is basically open to the surrounding environment and thus, there is an urgent need to provide a rapid engagement of the radiant heater 35 to supply that needed heat to the infant as soon as possible.

Figure 4:
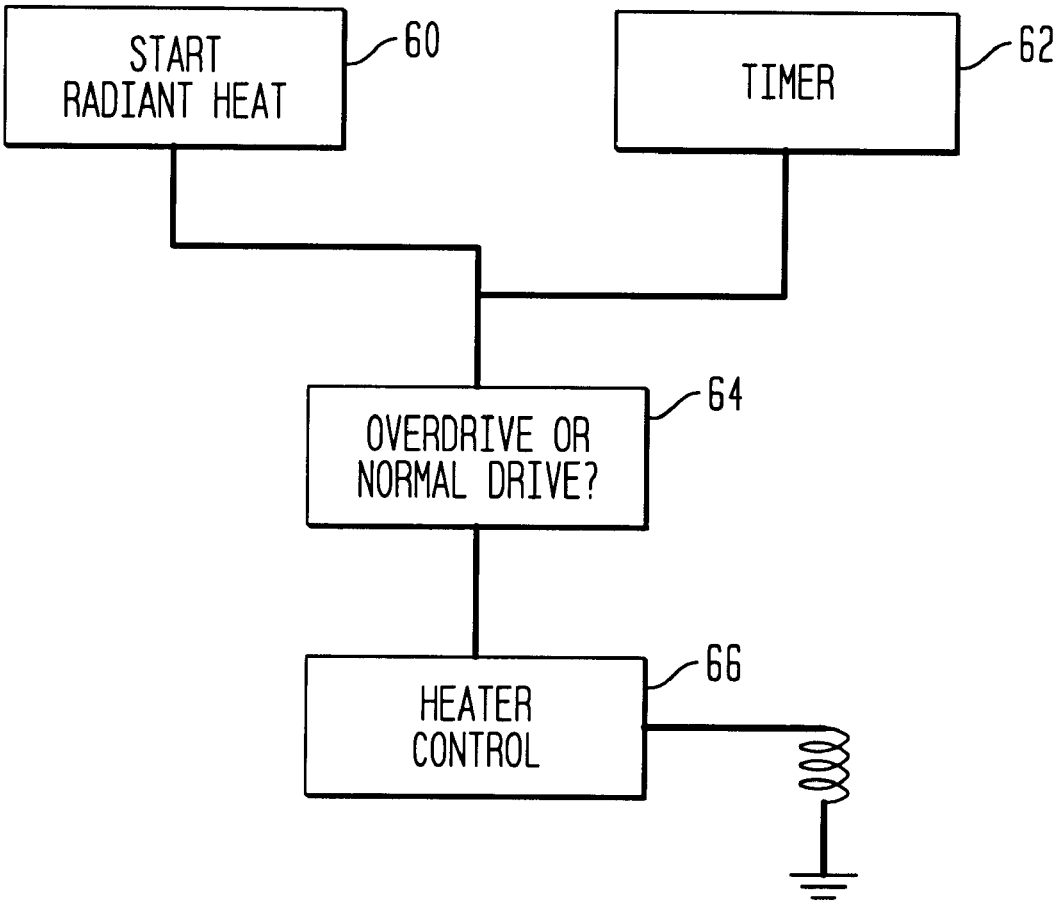
FIG. 4 is a block diagram of the control system for controlling the initial start-up of a radiant heater used with the apparatus of FIGS. 1–3.

Turning now to FIG. 4 in conjunction with FIGS. 1–3, there is shown a block diagram of a control system for use with the present invention used upon start-up of the radiant heater 35. In the Fig., there is a start-up block 60 that basically controls the initialization of the radiant heater 35. In the preferred embodiment with the infant apparatus herein described, the start-up would occur when the canopy has reached its upper position. At that point, the system of the embodiment is set to power up the radiant heater 35 at an initial power setting of 100% power, 50% power or may be some other percentage of full power.

The initialset power to the heater may be establish by a servo control system responsive to the temperature of the infant or may be a manually inputted power. As a further alternative, there may be a default setting for the setting of set percentage of full power if a manual input is requested but no such input has been carried out by the user. In any event, there is a set power at start-up of eh radiant heater that is a percentage of the 100% rated power of the heater.

Accordingly a timer is commenced or started upon power up and that timer determines the duration of the time that the power is supplied to the radiant heater at a percent in excess of the normal 100% rated power. Thus, at the start up, assuming, just for an example, the normal 100% rated power to the radiant heater is 400 watts, the system will initially provide power to the radiant heater power in excess of the normal rating, that is, the system will initially supply 450 watts to the heater, or about 112% of the full rated power of the heater at start up in order to more rapidly bring the radiant heater up to the desired temperature.

A timer 62 determines the duration of the application of the excess power to the radiant heater. That time is preferably based upon the initial set power to the radiant heater upon start-up. As indicated, the start up set power established by the user, determined by a servo control or default setting is established as a percentage of the rated power to the heater. Thus, the duration of the excess power delivered to the radiant heater as controlled by the timer 62 is determined by the set power. If, for example, the set power is 100%, indicating that the user or the system wants the heater to be at 100% of its rated power, 400 watts in the example, the excess power of 450 watts would be applied for a duration of time determined by the set power setting where, again for purposes of an example, that 112% power would be supplied to the heater for about 100 seconds and then discontinued so that the heater can return to its normal operational algorithm to thereafter control the power to the heater.

If, on the other hand, the desired power set by the user or established by the servo control system is at 50% power, the excess power of 450 watts would be supplied to the radiant heater for a duration of about 50 seconds since less time is needed to reach the desired heater power or temperature.

Thus, depending upon the timer 62, the controller 64 determines whether the heater control 66 is providing the excess power to the heater or has returned the system to the normal control of the heater power.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

What is claimed is:

1. A method of controlling the energy to a radiant heater having a 100% power rating, said method comprising the steps of:

a. providing power to the radiant heater upon start up at a power level a predetermined percentage in excess of the 100% rated power, b. determining a time for the application of the excess power, and c. discontinuing the application of the excess power in step (a) after the passage of a time determined by the timing step (b).

2. A method of controlling the energy to a radiant heater as defined in claim 1 wherein said system further comprises the steps of providing an initial set power for the radiant heater and determining the time of step (b) is dependent upon the initial set power.

3. A method of controlling the energy to a radiant heater as defined in claim 2 wherein said step of determining the time for the application of the excess power determines a longer period of time for a higher initial set power.

4. A method of controlling the energy to a radiant heater as defined in claim 1 comprises providing power to the radiant heater at about 112% of the rated power rating of the heater.

5. An infant care apparatus, said apparatus comprising a base, an infant platform affixed to said base and having surface on which an infant is positioned, a canopy mounted to said base, said canopy being movable between a lower position wherein said canopy fits over said infant platform to form an infant compartment enclosing an infant and an upper position where said canopy is elevated with respect to said infant platform and said infant compartment is open, a mechanism for raising and lowering said canopy with respect to said infant platform to open and close said infant compartment, a convective heating system to provide heated air into said infant compartment when said canopy is in said lower position, and a radiant heater having a known 100% rated power affixed to said canopy to provide radiant heat energy to said infant positioned on said surface, and a control system, said control system adapted to energize said radiant heater at a power level in excess of the 100% rated power of the heater for an initial period of time, said control system discontinuing the application of the excess power to the heater after said period of time.

6. An infant apparatus as defined in claim 5 wherein said control system provides an initial set power desired for the heater upon initial energization of said heater and wherein the period of time is determined by that initial set power.

7. An infant apparatus as defined in claim 6 wherein said excess power is about 112% of the rated power of the heater.

8. An infant apparatus as defined in claim 6 wherein said time period is longer for higher initial set power to the heater.

9. An infant care apparatus, said apparatus comprising a base, an infant platform affixed to said base and having surface on which an infant is positioned, a radiant heater affixed to said base to provide radiant heat energy to said infant positioned on said surface, and a control system, said control system adapted to energize said radiant heater at a power level in excess of the 100% rated power of the heater for an initial period of time, said control system discontinuing the application of the excess power to the heater after said period of time.

10. An infant apparatus as defined in claim 9 wherein said control system provides an initial set power desired for the heater upon initial energization of said heater and wherein the period of time is determined by that initial set power.

11. An infant apparatus as defined in claim 9 wherein said excess power is about 112% of the rated power of the heater.

12. An infant apparatus as defined in claim 9 wherein said time period is longer for higher initial set power to the heater.

* * * * *